US005166699A

United States Patent [19]

Yano et al.

[11] Patent Number: 5,166,699

[45] Date of Patent: Nov. 24, 1992

[54] RECORDING APPARATUS

[75] Inventors: Kentaro Yano; Noribumi Koitabashi, both of Yokohama; Naoji Otsuka, Kawasaki; Miyuki Matsubara, Tokyo; Hitoshi Sugimoto, Yokohama; Atsushi Arai, Kawasaki; Hiroshi Tajika; Hiromitsu Hirabayashi, both of Yokohama, all of Japan

[73] Assignee: Canon Kabushiki Kaisha, Tokyo, Japan

[21] Appl. No.: 682,364

[22] Filed: Apr. 9, 1991

[30] Foreign Application Priority Data

Apr. 11, 1990 [JP] Japan ..... 2-095408

[51] Int. Cl.[5] ..... B41J 2/05; B41J 2/195

[52] U.S. Cl. ..... 346/1.1; 346/140 R; 400/54

[58] Field of Search ..... 346/140 R, 75, 1.1, 346/76 PH; 400/50, 51, 54, 124, 719, 120, 126; 101/93.05

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,352,114 | 9/1982 | Kyogoku et al. | 346/140 R |
| 4,449,033 | 5/1984 | McClure et al. | 219/216 |
| 4,459,600 | 7/1984 | Sato et al. | 346/140 R |
| 4,463,359 | 7/1984 | Ayata et al. | 346/1.1 |
| 4,544,931 | 10/1985 | Watanabe et al. | 346/140 R |
| 4,558,333 | 12/1985 | Sugitani et al. | 346/140 R |
| 4,688,051 | 8/1987 | Kawakami et al. | 346/76 PH |
| 4,723,129 | 2/1988 | Endo et al. | 346/1.1 |
| 4,740,796 | 4/1988 | Endo et al. | 346/1.1 |
| 4,791,435 | 12/1988 | Smith et al. | 346/140 R |
| 4,910,528 | 3/1990 | Firl et al. | 346/1.1 |
| 4,947,194 | 8/1990 | Kyoshima | 346/140 R |

FOREIGN PATENT DOCUMENTS

| | | | |
|---|---|---|---|
| 0390198 | 10/1990 | European Pat. Off. . | |
| 3039164 | 5/1981 | Fed. Rep. of Germany . | |
| 54-056847 | 5/1979 | Japan . | |
| 55-070256 | 5/1980 | Japan . | |
| 0124684 | 9/1980 | Japan | 400/124 TC |
| 0117668 | 9/1981 | Japan | 400/124 TC |
| 57-157781 | 9/1982 | Japan . | |
| 0007380 | 1/1983 | Japan | 219/216 |
| 0059859 | 4/1983 | Japan | 400/50 |
| 59-123670 | 7/1984 | Japan . | |
| 59-138461 | 8/1984 | Japan . | |
| 60-071260 | 4/1985 | Japan . | |
| 0244655 | 10/1987 | Japan | 400/124 TC |
| 0244679 | 10/1987 | Japan | 400/124 TC |
| 63-116857 | 5/1988 | Japan . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recording apparatus having a recording head provided with plural ink discharging outlets for discharging ink includes a detector for detecting temperature distribution in the recording head relating to recording operation of the recording head; and a controller responsive to an output of the detector to control a recording speed of the recording head.

10 Claims, 9 Drawing Sheets

RECORDING APPARATUS

FIELD OF THE INVENTION AND RELATED ART

The present invention relates to a recording apparatus having a recording head provided with plural heat generating elements and for controlling the recording apparatus in accordance with a temperature distribution of the recording head, more particularly to a recording apparatus such as printer, copying machine or facsimile machine or other office equipment using an ink jet recording process in which ink discharging or ejection is decisive for the quality of the record.

A thermal energy recording system using film boiling of liquid is advantageous over the recording system using piezoelectric elements and other thermal energy recording using light energy or the like, and therefore, is now put into practice. In a conventional recording head not using heat generating elements, such as a wire dot printer or other impact printers, response of the recording head becomes slow due to the heat generation by the solenoid or electromagnetic coil for driving the wires or the like even to such an extent of incapability of the recording. Solutions to this problem have been proposed. For example, Japanese Laid-Open Utility Model Application No. 70256/1980 proposes as a solution that bidirectional printing operation is switched to a monodirectional printing to provide a longer heat emitting period, thus recovering the solenoid. Japanese Laid-Open Patent Application No. 157781/1982 proposes the same switching for the purpose of emitting the heat due to the exciting current to the coil for the driving wire.

The heat generation by the solenoid or the coil of this kind is due to the accumulation of the heat produced in a long period. The recording speed is not so high. Therefore, the temperature detected relates to the abnormally high temperature resulting in the incapability of the recording, not the temperature distribution.

As for the ink jet recording system, U.S. Pat. No. 4,544,931 has proposed that the recording speed, recording frequency and the carriage moving speed are controlled in accordance with the ambient temperature in order to avoid the influence of the ink viscosity change which depends on the external ambient temperature. U.S. Pat. No. 4,910,528 proposes the recording conditions are determined on the basis of the temperature of the recording head using a heat generating element. For the detection of the recording head temperature, only one temperature sensor is used, and therefore, the temperature of a part of the recording head is used as a representative head temperature.

The present invention is directed to the variation in the ink ejections which is particularly remarkable in an ink jet recording head in which heat generating elements are disposed in liquid passages of the recording head. The variation is caused by accumulation of thermal energy in the ink or the parts constituting the liquid passage with the result of different temperature regions. Generally, the thermal head used in a thermal transfer type recording system does not have an ink passage, and therefore, the heat accumulation is not a problem. However, it will be a problem if a high quality and high tone gradation images are produced using small temperature differences.

In any case, the conventional temperature control of the recording head using a single temperature sensor is effective to prevent such a serious malfunction as to prevent the ejection of ink. However, it is not effective to prevent non-uniform volumes of the liquid ejected from plural liquid passages in a so-called multi-nozzle head having plural ejection outlets and corresponding liquid passages. The description will be made as to one of the causes of the non-uniformity.

Referring first to FIG. 6, there is shown the number of ejections from the respective ejection outlets when usual English sentences having 1500 characters are recorded in an ink jet recording apparatus having an ink jet recording head with 48 ejection outlets with the resolution of 360 dpi (dot per inch). As will be understood from this graph, the numbers of ejections are remarkably different in the usual English sentences. As will be understood from the principle of the ink jet ejection, the difference in the ejection numbers is the difference in the number of thermal energy applications. The difference results in the difference in the temperature of the ink in the liquid passages. Because of the temperature differences, the sizes of the bubbles produced by the head vary even if the same voltages having the same pulse width are applied. As a result, the volume of the ejected liquid varies with the individual ejection outlets.

If the volume of the ejections are different, the following problems arise. The volume of the ejection concerns the size of the dot recorded on the recording material.

As shown in FIG. 7, if there are large volume ejection outlets and small volume ejection outlets simultaneously, the degree of overlapping between adjacent dots are different. When, for example, the tone gradation is expressed as the number of dots, the uniform density area may be recorded as a non-uniform area, or a partial dark stripe will result, or on the contrary, a light stripe will be conspicuous.

SUMMARY OF THE INVENTION

Accordingly, it is a principal object of the present invention to provide an ink jet recording apparatus and method and ink jet recording head wherein the difference in the volume of the ejected liquid is avoided.

It is another object of the present invention to provide an ink jet recording apparatus and method or a recording head wherein record non-uniformity, such as dark or light stripes can be avoided.

It is a further object of the present invention to provide a recording apparatus and method or control method wherein the temperature distribution of the recording head is detected or predicted, and if desired, the recording operation is stopped for a short period of time, and then, the recording operation is permitted.

It is a further object of the present invention to provide an ink jet recording apparatus wherein bubbles are formed by thermal energy and the interruption period is short.

According to an aspect of the present invention, there is provided a recording apparatus having a recording head provided with plural ink discharging outlets for discharging ink, comprising: detecting means for detecting temperature distribution in the recording head relating to recording operation of said recording head; and control means responsive to an output of said detecting means to control a recording speed of said recording head.

According to another aspect of the present invention, there is provided a record control method in a recording on a recording material using an ink jet recording head having thermal energy generating elements corresponding to plural discharging outlets, comprising: discriminating a temperature distribution in the recording head; discriminating continuation of recording by said recording head or interrupting of the recording in accordance with a result of said temperature distribution discriminating step; and resuming the recording operation after the interruption by said continuation or interruption discriminating step.

According to a further aspect of the present invention, the recording head is provided with detecting means for detecting the temperature distribution in the recording head as a result of recording operation, and the recording speed is controlled on the basis of the detection. The recording apparatus further comprises discharging means for forcedly discharging the ink through the plural ejection outlets of the recording head by application of pressure, and the discharging means is controlled on the basis of the temperature distribution detected by the detecting means.

According to the present invention, the temperature distribution detecting means and the recording speed control means function to reduce the variation in the volume of the ink droplet (ejection volume). Therefore, irrespective of the pattern of the record, the non-uniformity in the density such as dark or light stripes can be suppressed on the recorded image or character, and therefore, a high quality image can be provided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Embodiment 1

Figure 1:
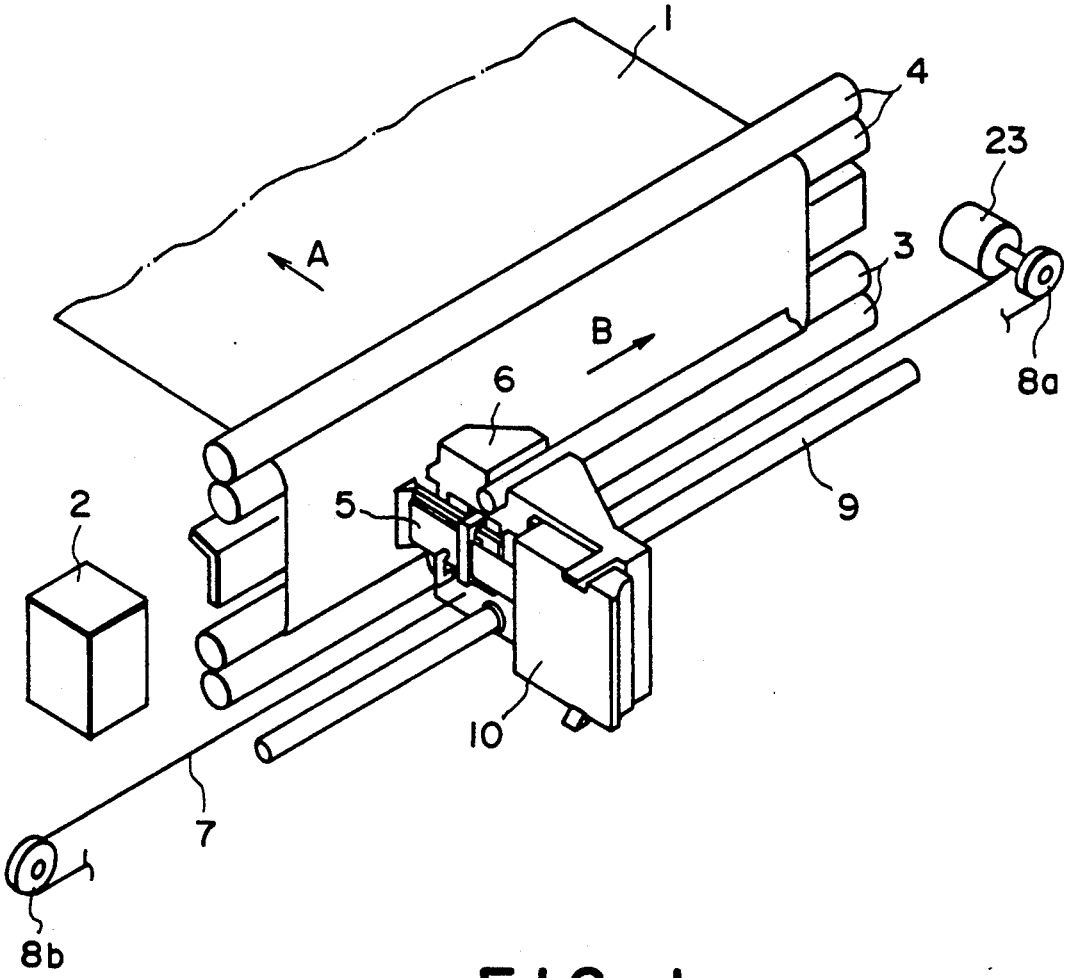
FIG. 1 is a perspective view of an example of an ink jet recording apparatus to which the present invention is applicable.

Referring to FIG. 1, there is shown an ink jet recording apparatus to which the present invention is applicable. The description will be made first as to the entire structure of the recording apparatus. Reference numeral 1 designates a recording material (recording sheet) of paper or plastic sheet or the like. Plural recording sheets 1 are accommodated in a cassette or the like and are fed out by a feeding roller, not shown in FIG. 1, one-by-one. Each fed sheet is conveyed in a direction indicated by an arrow A by a first pair of rollers and a second pair of rollers which are driven by respective stepping motors (not shown), the first and second pairs of rollers being disposed at a predetermined interval.

An ink jet recording head 5 effects recording on the recording sheet 1. The ink is supplied from an ink cartridge 10 and is discharged or ejected through ejection outlets of the ink jet recording head in accordance with image signals. The recording head 5 and the ink cartridge 10 are carried on a carriage 6 which is connected with a carriage motor 23 through a belt 7 and pulleys 8*a* and 8*b*. Therefore, the carriage motor 23 reciprocates the carriage 6 along a guide shaft 9.

The recording head 5 moves in the direction B, during which it ejects the ink onto the recording sheet 1 in accordance with the image signal. As required, the recording head 5 returns to its home position and is subjected to a recovery operation by recovery system means 2 so that the clogging of the ejection outlets or the like is removed, thus improving the ejection condition. The feeding rollers 3 and 4 are driven to feed the recording sheet 1 by one line in the direction A. By repeating these operations, a desired recording is effected on the recording sheet 1. The recovery system 2 includes a cap engageable with the ejection outlet side surface of the recording head 5 and a pump communicating with the cap to apply a suction force to the ejection side surface.

The description will be made as to the control system for driving the above-described parts.

Figure 2:
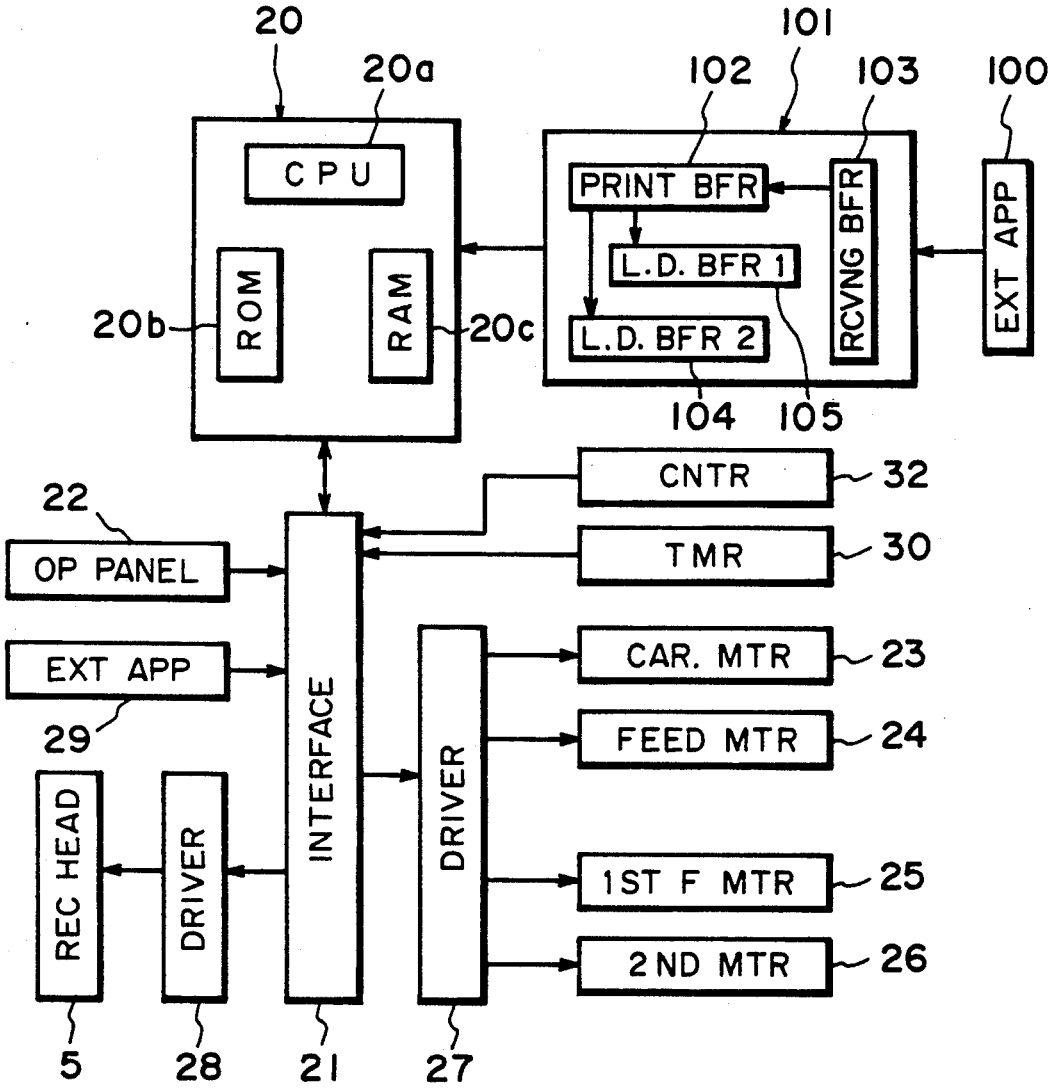
FIG. 2 is a block diagram of a control system for an ink jet recording apparatus according to an embodiment of the present invention.

FIG. 2 shows an example of the control system, which comprises CPU 20*a* in the form of a microprocessor or the like, a ROM 20*b* for storing a control program for the CPU 20*a* or various data, a RAM 20*c* used as a working area of the CPU 20*a* and for temporarily storing various data. They are included in a controller 20. The control system further includes an interface 21, an operation panel 22, various motors (carriage driving motor 23, sheet feeder driving motor 24, a first pair roller driving motor 25 and a second pair roller driving motor 26), drivers 27 for driving the motors and a recording head driver 28.

The controller 20 receives various information (character pitch, character font or the like) from the operation panel 22 through the interface 21 and receives the image signal from an external apparatus 29. The controller 20 outputs on and off signals for driving various motors 23–26 and the image signals through the interface 21, so that various parts are driven in accordance with the image signals.

Information of number of ejections through each of the ejection outlets per unit time is detected by a cooperation of a timer 30 and a counter 32, and is supplied to the controller 20 through the interface 21.

In the above structures, the increase of the ink in the liquid passage and adjacent thereto is significantly different depending on the number of ejections per unit In the first embodiment, the ink temperature in the passage is predicted on the basis of the count of ejection numbers for each of the ejection outlets per unit time, but the temperature may be directly detected for each of the liquid passages.

Figure 4:
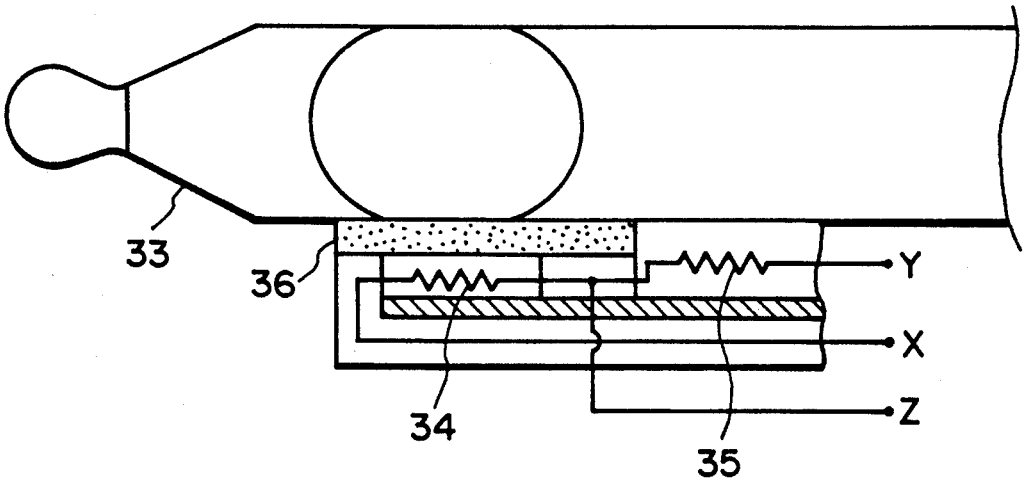
FIGS. 4 and 5 are perspective views of a recording head according to another embodiment of the present invention.

FIG. 4 illustrates the liquid passages in a multi-nozzle type recording head. When a driving signal is applied between points X and Y in FIG. 4, the electrothermal transducer 34 generates heat, and the generated thermal energy is transferred to the ink I in the passage 33 through a protection coating 36. Then, a film boiling occurs to produce a bubble B, upon which a droplet of ink D is ejected through the ejection or discharge outlet. A temperature sensor 35 of resistance change detection type is disposed at a position sufficiently close to the liquid passage but without thermal influence from the electrothermal transducer 34. The voltage drop through the temperature sensor 35 is detected between the points Y and Z, so that the ink temperature is detected. This structure is provided for each of the liquid passages, and therefore more accurate information on the temperature can be obtained. On the basis of the detections, the temperature distribution of the head can be correctly discriminated. On the basis of the detected temperature distribution, the recording speed is controlled in the same manner as described above. With the conventional temperature detection using a single temperature sensor, the temperature change of only a part of the only a few passage or passages of a great number of passages is detected, and on the basis of that, the entire head is controlled in the same manner. Therefore, the control error was rather significant. Although a very significant malfunction such as improper ejection can be avoided, the density non-uniformity or the like due to the difference in the ejection volumes is not dealt with.

According to this embodiment, however, the recording head is divided into the minimum areas to detect the temperatures, more particularly, to each of the liquid passages for the temperature detection. Therefore, the difference in the ejection volume of the ink can be minimized, thus accomplishing the high quality image record.

Figure 6:
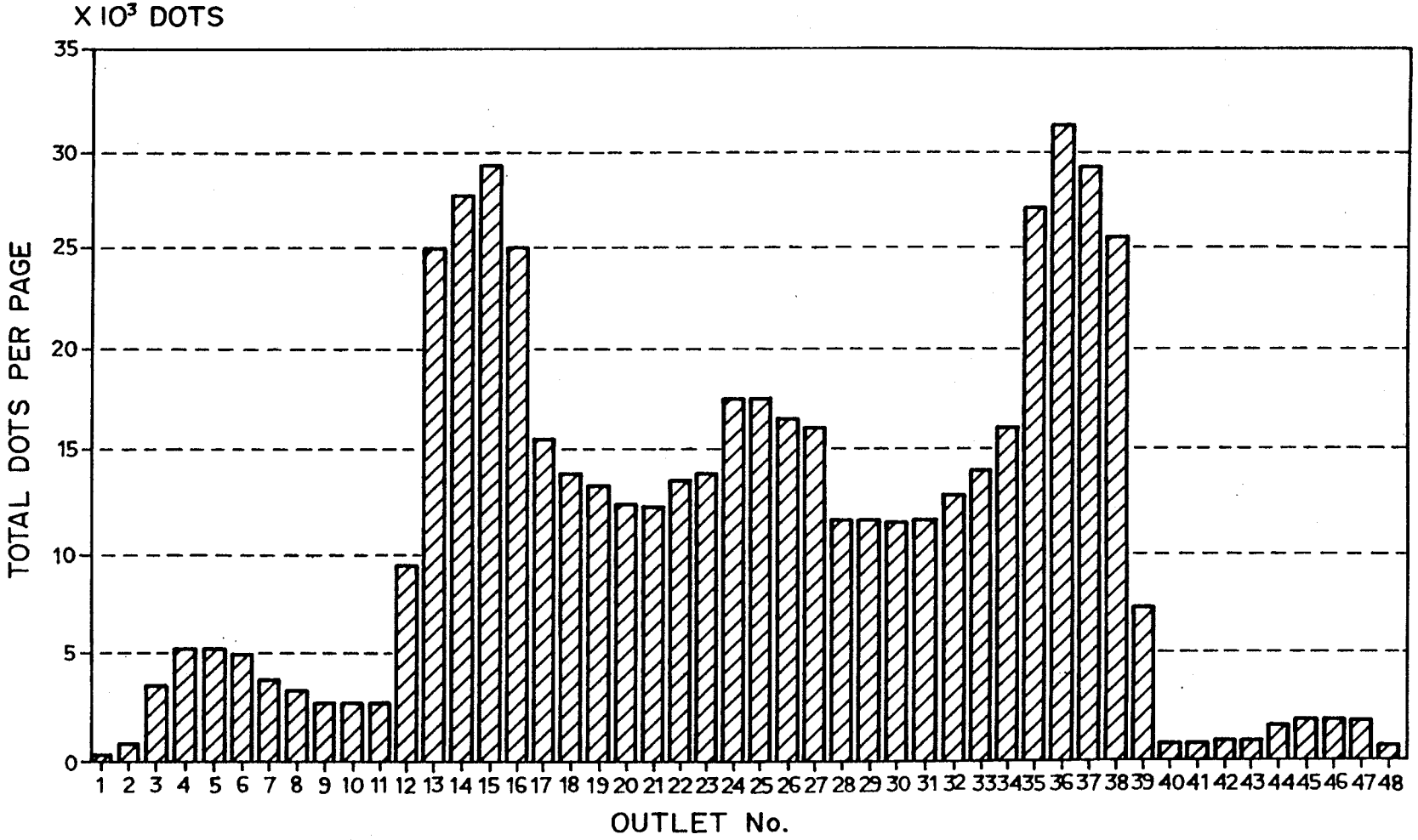
FIG. 6 is a graph showing variation in the ejection numbers.
Figure 7:
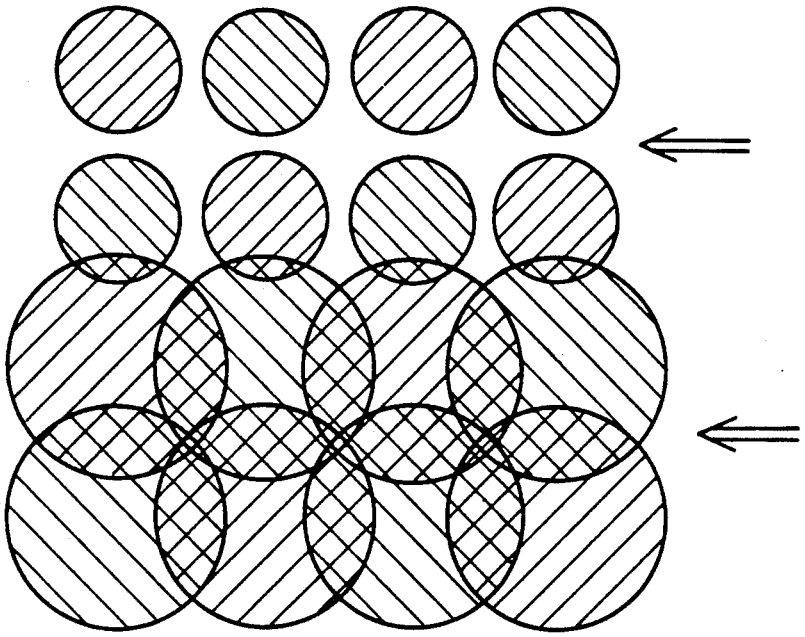
FIG. 7 illustrates the dot pattern formation when the ejection volumes are different.

In this embodiment, the temperature detection is effected for all of the respective liquid passages. However, depending on the use of the recording apparatus, more particularly, if, for example, the recording apparatus is used to record a list of a program, or the recording apparatus is for mainly recording documents, the ejection outlets through which the ejections are effected at high frequency and the ejection outlets through which the ejections are effected at lower frequency can be easily predicted, as will be understood from FIG. 6. Therefore, the temperature may be detected at only proper parts such as two or more positions representative of the temperature distribution. In this case, the detection of the temperature is not inevitable, but the duty of the signal pulses may replace. As a further alternative, if the main purpose of the control is directed to provide better connection between dots, the comparison may be made between the ejection outlets numbers 1–8 and the ejection outlets numbers 41–48 in FIG. 6. As for the entire image density, the comparison may be made between the ejection outlets numbers 13–16 and the ejection outlets numbers 35–38. The specific outlet compared above are not meant be limiting in to the above-mentioned embodiment.

Figure 5:
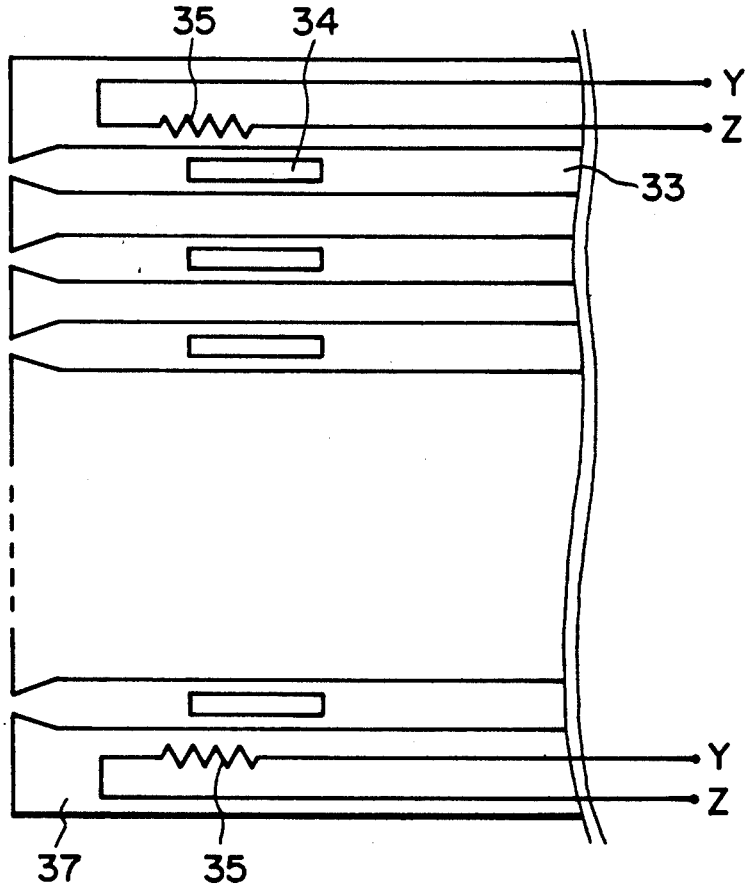

When the recording operation is effected for each recording width by serial scans, there is a tendency that the density non-uniformity is particularly conspicuous at the connection between the recording widths. This is because in the serial scan, there exists a connection line on the recorded image between the line recorded by the bottom ejection outlet in the (n)th scan and the line recorded by the top ejection outlet of the (n+1)th scan. If there is a temperature difference between the bottom ejection outlet and the top ejection outlet, the density non-uniformity occurs for the reasons described hereinbefore. In consideration of this, as shown in FIG. 5, two temperature sensors (temperature sensor 35 of a resistance change detecting type) are at the opposite ends of the array of the liquid passages 33 on the base plate 37, and the voltage drop of the temperature sensor is detected by the voltage between the points Y′ and Z′. If the temperature difference detected exceeds a predetermined level, the above-described control is carried out.

It is a possible alternative that the temperature distribution is detected by a combination of temperature detectors using the ejection number per unit time according to the first embodiment and the temperature detection by the temperature sensor. This is particularly advantageous when, for example, it is difficult to dispose the temperature sensor adjacent to the liquid passages because of limitations resulting from the structure of the head or the like. Further, it is possible that the temperature of a particular region may be correctly detected by using both of the temperature sensor and the ejection number.

Embodiment 3

A further embodiment for further effectively preventing the temperature rise of the ink temperature in the nozzles, will be described. In the second embodiment, the temperature raising factor relating to the ejection and the temperature lowering factor resulting from the heat emission are balanced by changing the recording speed, thus controlling the ejection volume through the ejection outlets. The control is particularly effective under the abnormal temperature. However, if the abnormal temperature is exceeded, the recording operation can be resumed after a period of time which is shorter than in the conventional apparatus. However, it may not exceed 500 msec as the case may be. The third embodiment relates to the mode when the abnormal temperature is exceeded. This embodiment uses the recovery system 2 shown in FIG. 1.

Temperature rise due to the ejection is usually limited within the neighborhood of the liquid passage, and it is very seldom that the temperature rise extends to the ink within the ink cartridge 10. In consideration of the fact, when the necessity for the measure against temperature rise is detected by the temperature detecting means on the basis of the data relating to the number of ejections as in the first embodiment and the temperature detecting means as in the second embodiment, the carriage 4 is returned to the recover position, and the sucking operation is carried out, by which the high temperature ink is sucked out from the recording head, thus refreshing the liquid passage. Then, the temperature is quickly lowered with certainty.

Therefore, the foregoing embodiment system and the third embodiment system may be both used with a proper switching system to control the temperature of the ink adjacent the ink passage.

type. In this embodiment, however, the control is carried out so that the temperature rise is within a predetermined limit. The control for the suppression of the temperature rise will be described together with experimental data.

A recording head having the resolution power of 400 dpi (dot per inch) and having 128 ejection outlets was operated at the recording speed of 4000 dot per sec for each of the ejection outlets. The following has been found:

(1) When all of the ejection outlets are driven throughout one line (approximately 200 mm), the temperature of the ink adjacent the liquid passage rises by approximately 10° C. ($\Delta T = 10°$ C.).

This results in approximately 10% increase in the reflection image density on the recorded image as compared with the reflection image density when the temperature does not rise.

(2) When the temperature-raised head (ink) is left undriven, the temperature returns to the original level (equivalent to the external temperature).

(3) If the recording operation is continued with the increased temperature, the recording head (ink) temperature saturates on the basis of the balance between the rising factor by the recording and the lowering factor due to the heat emission to the ambience.

It is assumed that the change in the reflection density of the record is to be within 10%. Then, ejection interval N (dot per unit time) resulting in $\Delta T \leqq 10°$ C. is determined in consideration of the balance between the raising factor and the lowering factor. The interval N is stored in the ROM 20*b*. Then, the comparison is made between the interval N and the ejection number data for each of the nozzles supplied from the counter 32 for per unit time. If one or more ejection outlets is such that the ejection numbers per unit time exceeds the interval N, the recording speed is lowered. By carrying out such a control, that is, by controlling the ejection intervals, the temperature rise adjacent the liquid passages can be suppressed.

Figure 3:
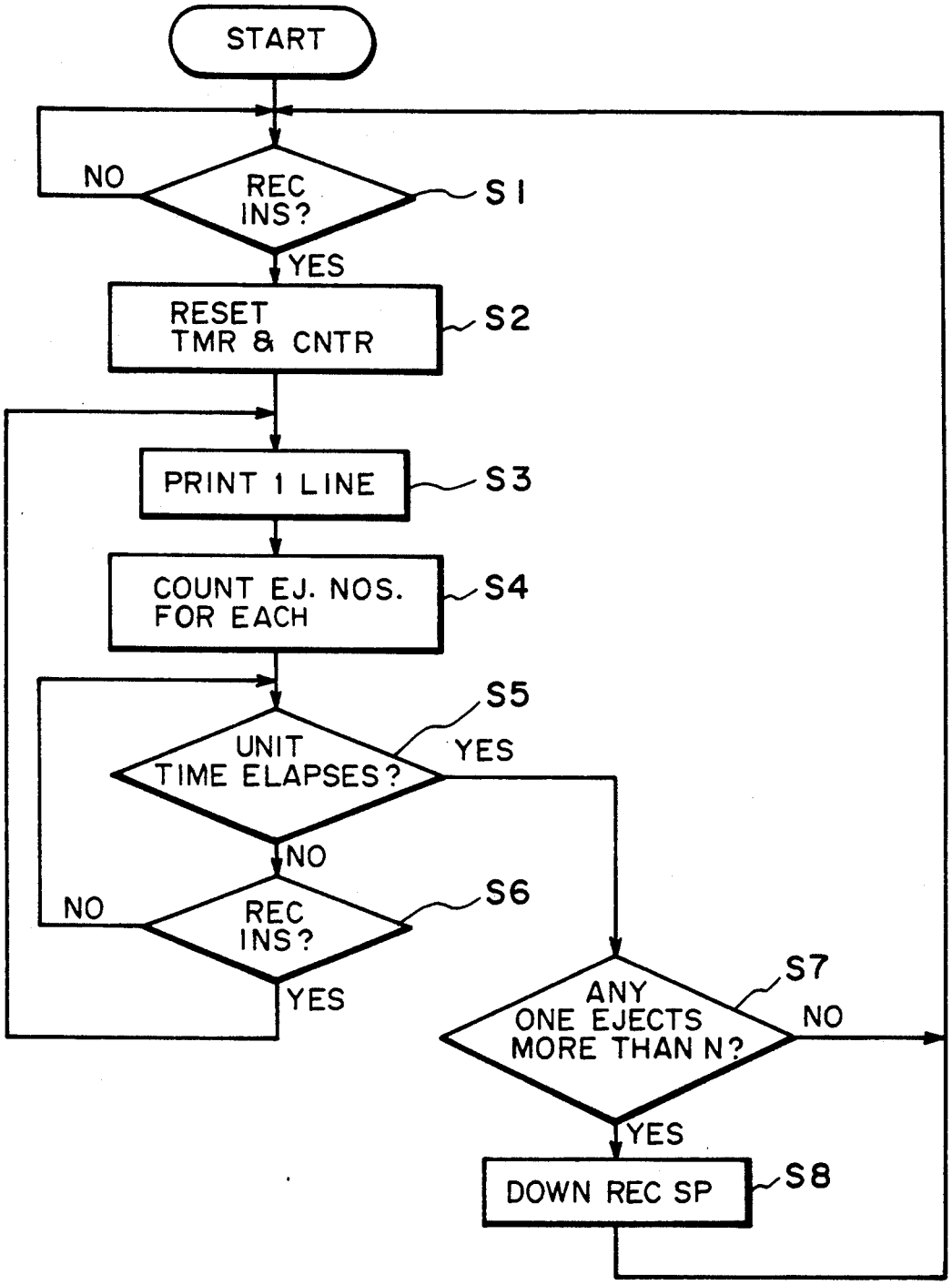
FIG. 3 is a flow chart illustrating an example of recording operation control process steps.

FIG. 3 shows an example of recording steps of the recording apparatus having the above-described structure. First, the recording instruction is produced to step S1. Then, the timer 30 and the counter 32 are reset at step S2, and the recording operation is started at step S3. During the operation, the counter 32 counts the number of ejections for each of the ejection outlets at step S4. The controller 20 receives information from the timer 30 to monitor passage of the unit time (step S5). If not, and if the recording instructions for the next line is produced (step S6), the operation returns to step S3, by which the recording operation is carried out again. If the recording instructions are not produced, the operation returns to step S5, by which whether the unit time is passed or not is checked continuously.

If the unit time elapses, the comparison is made at step S7 between the predetermined reference ejection interval N and the ejection numbers for each of the ejection outlets. If no ejection outlet ejects more than N, the operation returns to step S1 and waits for the recording instruction. If there is an ejection outlet ejected more than N times, the recording speed is lowered (step S8) in accordance with a predetermined table (interruption not longer than 500 msec) in order to avoid the difference in the ejection volumes from respective ejection outlets as a result of increase of the temperature rise. Then, the operation returns to step S1 and waits for the recording instructions.

The lowering of the recording speed is effected actually by reducing the recording ejection frequency (longer ejection intervals) and by lowering the scanning speed of the recording head in the serial type printer as in this embodiment. If, however, the present invention is applied to a so-called full-multi-type recording head having ejection outlets covering the entire recording width, the lowering of the recording speed is effected by reducing the ejection frequency and by decreasing the recording material feeding speed.

Because of the above-described control, no ejection outlet ejects at the intervals resulting in the temperature rise, and therefore, the variation in the bubble formation or the bubble size becomes uniform over the entire liquid passages. Accordingly, the image density non-uniformity such as black or white stripes can be prevented thus providing the high quality image.

The ejection interval N for balancing the temperature rise and the temperature lowering may be influenced by the temperature of the ambience in which the recording apparatus is installed. In consideration of this, the interval N may be set as a function of external temperature t ($f(t) = Nt$).

Referring back to FIG. 2, the recording signal supplied from the external apparatus 29 is supplied to the RAM 20*c* (receiving buffer) of the controller 20 through the interface 21. The recording signal (code signal) is converted to heating signals for the electrothermal transducer corresponding to each of the liquid passages. In this embodiment, the control is started after the temperature of the ink rises adjacent the liquid passage as a result of ejections. However, it is a possible alternative that the counting operation is effected when the record signal is converted to the heating signals, and the proper recording speed is selected before the temperature rise actually occurs. In addition, the previous ejection data per unit time or the further previous ejection number data may be taken into account for the recording speed control.

In any case, on the basis of the data relating to the number of recorded dots or ejections, the temperature distribution of the ink adjacent the liquid passage is detected. In accordance with the detection, the recording speed is controlled so as to control the ejection intervals. By doing so, the degree of the temperature rise of the ink adjacent the liquid passages is controlled. Thus, the difference in the volume of the ejections among the ejection outlets can be reduced. As a result, irrespective of the pattern of the record, the density non-uniformity such as black stripes, white stripes or the like on the recorded image can be prevented, thus accomplishing a high quality image record.

According to this embodiment, the control system is responsive to such a small non-uniformity of the temperature distribution as is lower than the conventional abnormal temperature, and therefore, the long non-recording period required for the temperature to return to the normal temperature is not required. In addition, the non-uniformity in the record which has conventionally been produced until the abnormal temperature is reached, can be significantly improved. Therefore, good images can be produced.

Embodiment 2

Another embodiment in which different ink temperature distribution in the head is detected, will be described.

The recovery system may be the one provided in the ink jet recording apparatus for the purpose of recovering the recording head from clogging of the ejection outlets or the like. In an example of such a recovery system, the recovery system 2 is movable toward and away from the recording head 5. It comprises capping means for hermetically covering the front surface of the recording head at its front position and pump means for sucking the ink out of the ink ejection outlets through the capping means. By operating the pump while the recording head is hermetically covered by the capping means, a vacuum is produced within the capping means, thus sucking the ink out through the nozzle.

Figure 8:
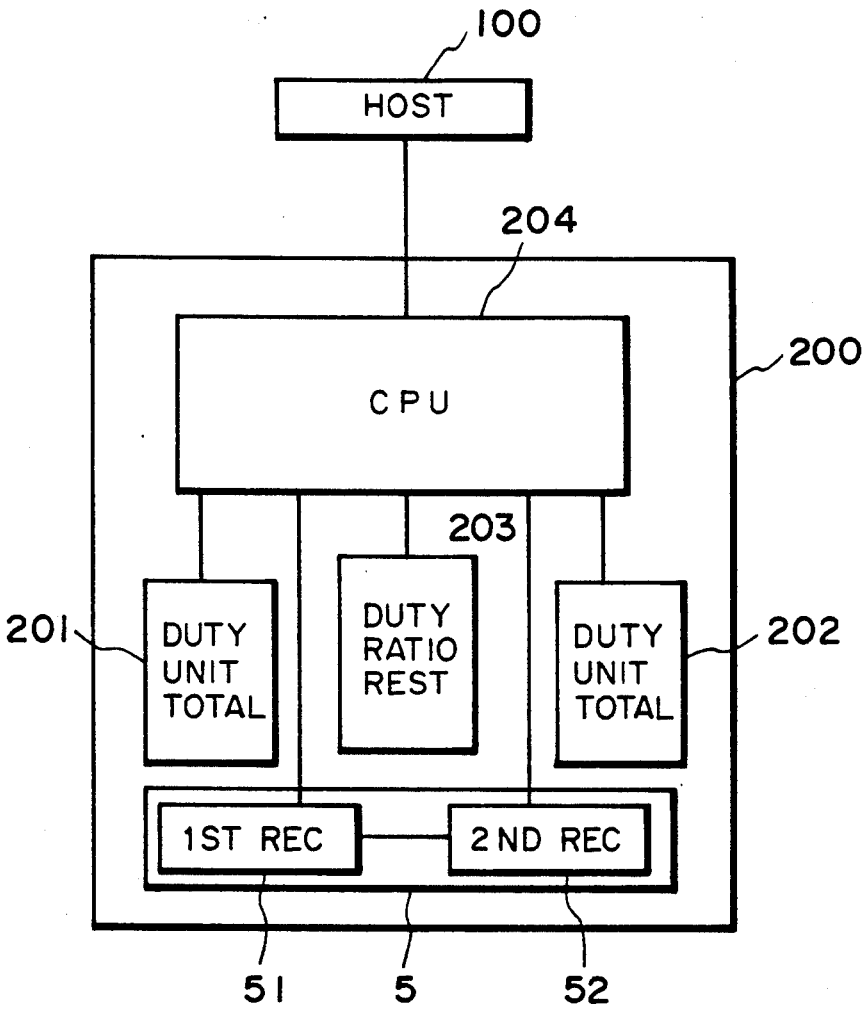
FIG. 8 illustrates the temperature distribution discrimination on the basis of record information.
Figure 9:
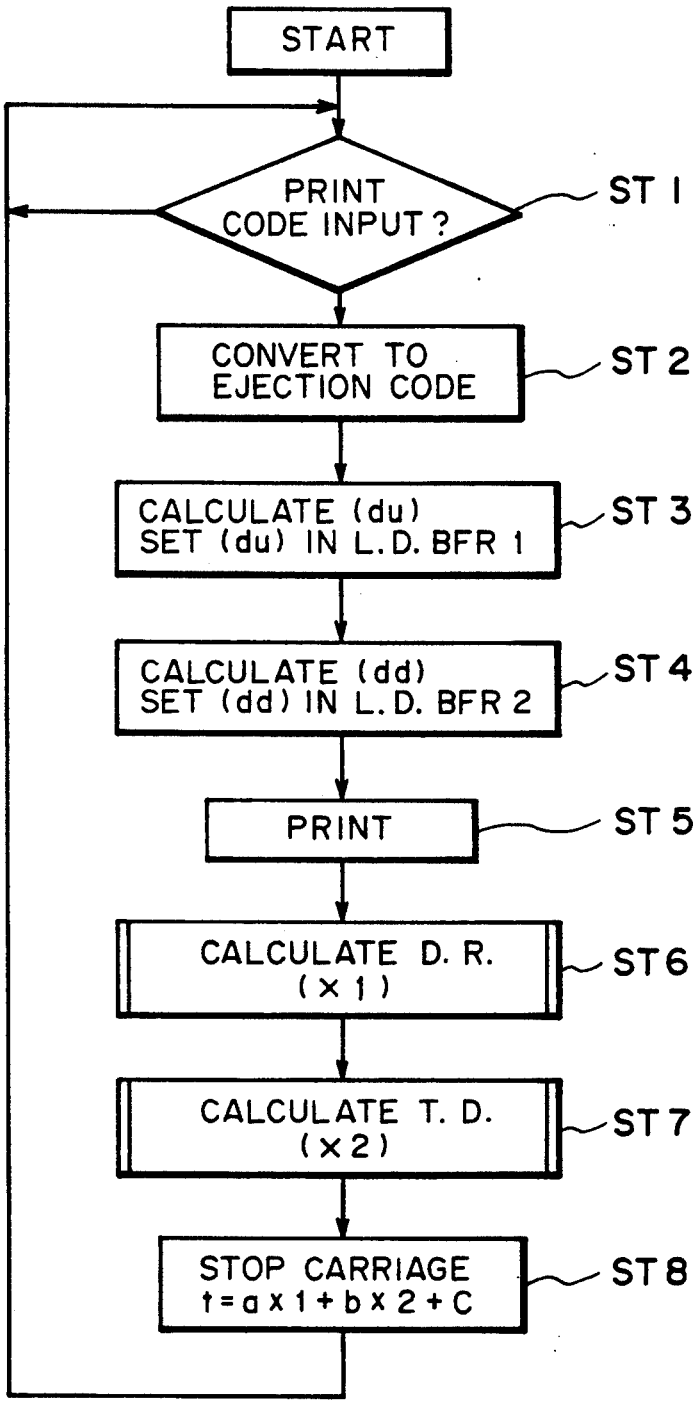
FIG. 9 is a flow chart responsive to the data from a host apparatus of FIG. 2.
Figure 10:
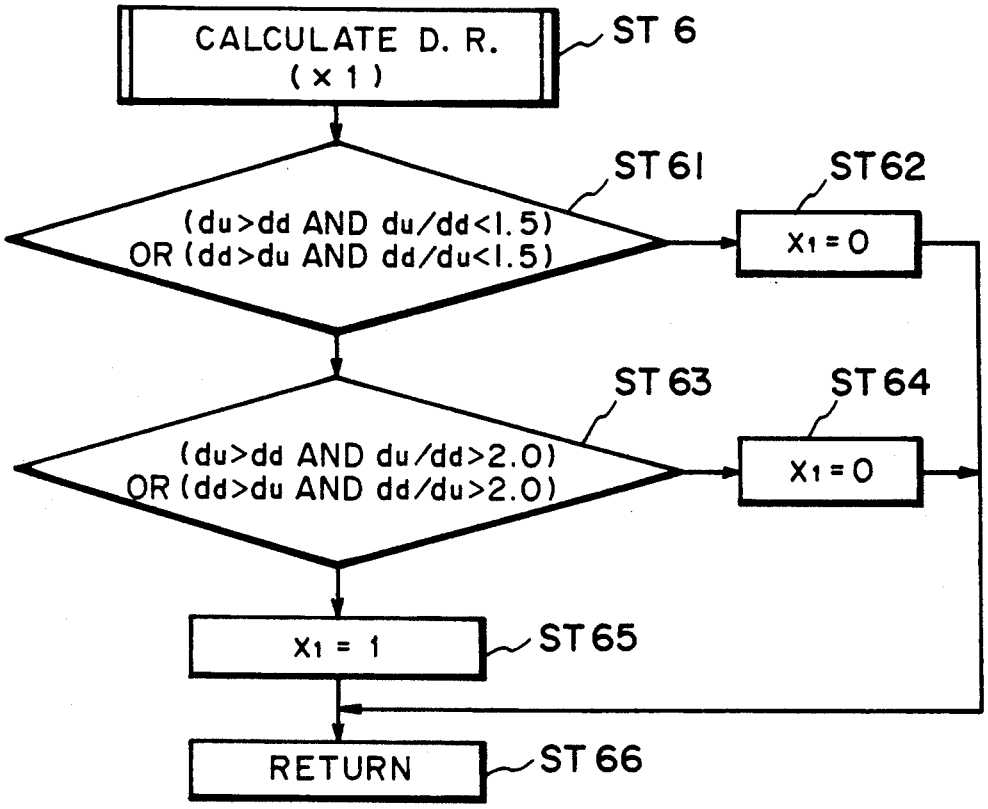
FIG. 10 shows a sub-routine for discriminating duty ratio in the flow chart of FIG. 9.
Figure 11:
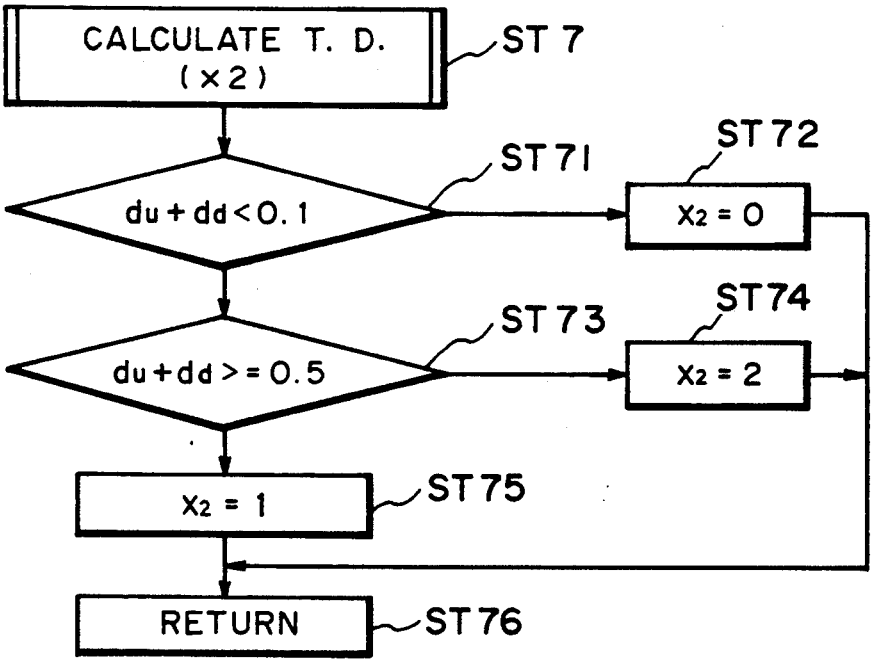
FIG. 11 shows a sub-routine for discriminating total duty in the flow chart of FIG. 9.

FIG. 8 is a block diagram of a drive control system 200 having a different structure. It comprises a usual central processing unit 204. In this embodiment, two regions of the recording head 5, that is a first region 51 and a second region 52 are the objects on the basis of which the temperature distributions are discriminated. In this example, the first and second portions are determined for the respective blocks in the block driving type system. By selecting the block unit as the control object, the accuracy of the duty ratio is assured, and therefore, preferable. The control objects may be selected for every two or three blocks.

Duty discriminating means 201 discriminates the drive signals supplied to the first recording region 51, it detects the duty per unit type and the total duty. Similarly, a discriminating means 202 discriminates the driving signal supplied to the second recording region 52. A stopping period discrimination means 203 receives from the central control means 204 the data relating to the discrimination of the duty determined by the means 201 and 202 and determines the stop period in accordance with the total duty and the duty ratio. The duty discriminating means are provided exclusively for the first and second recording regions, respectively, and therefore, the data required can be read in as desired. It is possible to supply the temperature data by the respective sensors for the first and second recording regions to the duty discriminating means. The stopping or interruption period is extremely small as compared with the normal ink jet recording speed of 200 mm/sec–400 m/sec.

Referring to FIGS. 2, 9, 10 and 11, more particular embodiments will be described. In this embodiment, the control is carried out to avoid the connection stripe between adjacent main scans in a serial printer. More particularly, the control avoids the temperature difference between the top ejection outlet and the bottom ejection outlet which is a main cause of the stripe at the connection.

| duty ratio<br>total-duty | <1.5 | ≧1.5<br><2.0 | ≧2.0 |
|---|---|---|---|
| <10% | — | 100 msec | 200 msec |
| ≧10% <50% | 100 msec | 200 msec | 300 msec |
| ≧50% | 200 msec | 300 msec | 400 msec |

In operation, when the printing code is supplied at step St1, the code is converted to a binary ejection code at step St2. Referring to FIG. 2, this will be described in detail. The printing code supplied from the external apparatus 100 such as a personal computer or the like is stored in a signal receiving buffer 103 in a gate array 101 for duty calculation. The print codes stored in the receiving buffer 103 are converted to binary ejection codes representing ejection/non-ejection for each of the nozzles, and the converted codes are supplied to the print buffer 102. At this time, the ejection duty (du) for the top half nozzles is stored in a line duty input buffer 105 in FIG. 2, whereas the ejection duty (dt) for the bottom half nozzles is stored in a line input buffer 2 (104) of FIG. 2 (at steps St3 and St4). Then, the printing operation is started at step St5. The CPU 20*a* can access to the two line input buffers 1 and 2 at any timing so that the ejection duty for the top half nozzles and the ejection duty for the bottom half nozzles can be detected.

After printing one line, a duty ratio calculating routine makes its calculation (x1), and a total-duty calculating routine makes calculation (x2), at steps St6 and St7. On the basis of the calculations, the carriage resting period (t) is calculated. On the basis of this, the scanning operation of the carriage is controlled. More particularly, in this embodiment, the carriage resting period (t) is calculated by the double regression function:

$$t = ax1 + bx2 + c$$

where a, b and c are constants, and a=b=100 and c=0, in this embodiment; and x1 and x2 are variables.

The duty ratio (x1) is calculated in the following manner by the duty ratio calculating routine. If the duty ratio between the top half nozzle and the bottom half nozzle is less than 1.5, x1=0; when the duty ratio is not less than 2.0, x1=2; otherwise, x1=1. In other words, when du>dd, and du/dd<1.5, or
dd>du, and dd/du<1.5
x1=0;
when du>dd, and du/dd≧2.0, or
dd>du, and dd/du≧2.0,
x1=2;
when dd>du, and 1.5≦dd/du<2.0,
x1=1.

The total duty (x2) is calculated by the total-duty calculating routine in the following manner. If a sum of the duty for the top half nozzle and the duty for the bottom half nozzle is not more than 10%, x2=0; if it is not less than 50%, x2=2; and otherwise, x2=1. In other words, when du+dd<0.1, x2=0
when du+dd≧0.5, x2=2
when 0.1≦du+dd<0.5, x2=1

In the serial type ink jet recording apparatus wherein the recording head scans in the main scan direction, the carriage resting period (t) for suppressing the connection stripe between scanning lines increases with the duty ratio between the upper nozzles and the lower nozzles, since then the difference in the ejection volumes from the upper nozzles and lower nozzles is larger. Therefore, the longer time is required for decreasing the temperature.

If the total duty is large, the heat accumulation in the head increases with the result of larger ejection volume. If a long print rest period occurs after large heat accumulation (transfer of the image or the like), the non-uniform print occurs between before and after the rest.

In the regression function, the carriage resting period (t) is determined. The constants a and b represent the weighing of the variables. In this embodiment, they are equivalent (=100).

In the description of the embodiment, the temperature of the head is controlled using the rest period of the carriage. However, the temperature may be controlled by one or more of the head driving frequency, the printing direction, the sucking recovery operation or the like. In addition, in the foregoing description, the duty detection is carried out for the top half nozzles and the bottom half nozzles. It is a possible alternative that a part of the top half nozzle and a part of the bottom half nozzle may be used. In addition, three or more nozzles may be detected for the duty detection. In the description, the carriage resting period is calculated by the regression function.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably those disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black ink, a multicolor mode with different color ink materials and/or a fullcolor mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in a usual recording apparatus of this type, the ink may be such that it is liquid within the temperature range when the recording signal is applied. However, the present invention is applicable to other types of ink. In one of them, the temperature rise due to the thermal, energy is positively prevented by consuming it the thermal energy for the state change of the ink from the solid state to the liquid state. Another ink material is solidified when it is unused, to prevent the evaporation of the ink. In either of the cases, with the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as a computer or the like, as a copying apparatus combined with an image reader or the like, or as a facsimile machine having information sending and receiving functions.

As described in the foregoing, according to the present invention, the temperature distribution of the recording head is predicted, discriminated or detected, and in response thereto, the recording speed is controlled. Therefore, the variation in the volume of the ink droplet per one dot ejected from an ejection outlet can be reduced, and therefore, uniform and therefore high quality images can be produced.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus having a recording head provided with plural ink discharging outlets for discharging ink, said apparatus comprising:

detecting means for detecting a temperature distribution in the recording head relating to a recording operation of said recording head; and control means responsive to an output of said detecting means to control a recording speed of said recording head, wherein said control means interrupts a recording operation for not more than 100 msec in accordance with the output of said detecting means.

2. An apparatus according to claim 1, wherein said detecting means detects the temperature distribution on the basis of data relating to a number of ink ejections in the recording operation for each of the discharging outlets.

3. An apparatus according to claim 1, wherein said detecting means detects the temperature distribution on the basis of detections of temperatures in each of the discharge outlets.

4. An apparatus according to claim 1, wherein said detecting means includes means for detecting the temperature distribution on the basis of data relating to a number of ink ejections during the recording operation from each of the discharging outlets, and means for detecting the temperature distribution on the basis of temperatures in the respective discharging outlets.

5. An apparatus according to claim 1, further comprising discharging means for forcedly discharging the ink through the ejection outlets by application of pressure, and second control means for driving said discharging means in response to an output of said detecting means.

6. An apparatus according to claim 1, wherein said recording head includes electrothermal transducers for the respective discharging outlets, the electrothermal transducers producing thermal energy to produce film boiling of the ink to discharge the ink for recording.

7. A recording control method for recording on a recording material with an ink jet recording head having thermal energy generating elements corresponding to plural discharging outlets, said method comprising the steps of:

determining a temperature distribution in the recording head;

discriminating, in accordance with a result of said temperature distribution determining step, whether a recording operation is to be continued or interrupted for an interruption period; and resuming the recording operation after an elapse of an interruption period determined in said discriminating step, wherein the interruption is not more than 100 msec.

8. A method according to claim 7, wherein said thermal energy generating elements comprise electrothermal transducer elements for producing bubbles of ink in response to recording signals.

9. A method according to claim 7, wherein said temperature distribution is determined by plural temperature detecting sensors disposed at different positions.

10. A method according to claim 7, wherein said discriminating step is performed on the basis of duty ratio per unit type of the recording signals supplied to predetermined plural regions of the recording head and a total duty supplied to the plural regions.

* * * * *

UNITED STATES PATENT AND TRADEMARK OFFICE

CERTIFICATE OF CORRECTION

PATENT NO. : 5,166,699

DATED : November 24, 1992

INVENTOR(S) : KENTARO YANO ET AL.

It is certified that error appears in the above-identified patent and that said Letters Patent is hereby corrected as shown below:

COLUMN 5

Line 34, "for" should be deleted.

COLUMN 7

Line 29, "only a few passage or" should read --passage or only a few--.
Line 67, "meant" should read --meant to-- and "to" should be deleted.

COLUMN 8

Line 14, "are" should read --are provided--.

COLUMN 12

Line 23, "fullcolor" should read --full-color--.
Line 37, "thermal," should read --thermal--.
Line 38, "it" should be deleted.

UNITED STATES PATENT AND TRADEMARK OFFICE

CERTIFICATE OF CORRECTION

PATENT NO. : 5,166,699

DATED : November 24, 1992

INVENTOR(S) : KENTARO YANO ET AL.

It is certified that error appears in the above-identified patent and that said Letters Patent is hereby corrected as shown below:

COLUMN 14

Line 36, "the" should be deleted.

Signed and Sealed this

Ninth Day of November, 1993

Bruce Lehman

*Attest:*

BRUCE LEHMAN

*Attesting Officer*

*Commissioner of Patents and Trademarks*